US009556641B2

(12) United States Patent
Milanowski

(10) Patent No.: US 9,556,641 B2
(45) Date of Patent: Jan. 31, 2017

(54) BALUSTER CONNECTOR

(71) Applicant: Universal Consumer Products, Inc., Grand Rapids, MI (US)

(72) Inventor: Daniel J. Milanowski, Grand Rapids, MI (US)

(73) Assignee: Universal Consumer Products, Inc., Grand Rapids, MI (US)

( * ) Notice: Subject to any disclaimer, the term of this patent is extended or adjusted under 35 U.S.C. 154(b) by 0 days.

(21) Appl. No.: 14/959,081

(22) Filed: Dec. 4, 2015

(65) Prior Publication Data

US 2016/0160525 A1 Jun. 9, 2016

Related U.S. Application Data

(60) Provisional application No. 62/088,092, filed on Dec. 5, 2014.

(51) Int. Cl.
*E04H 17/14* (2006.01)
*E04F 11/18* (2006.01)

(52) U.S. Cl.
CPC ..... *E04H 17/1443* (2013.01); *E04F 11/1842* (2013.01); *E04F 2011/1827* (2013.01); *E04H 2017/1469* (2013.01); *E04H 2017/1482* (2013.01)

(58) Field of Classification Search
CPC ..... E04H 17/1426; E04H 17/1439; E04H 17/1443; E04F 11/181; E04F 11/1819; E04F 11/1821; F16B 7/0446; F16B 7/0473; F16B 21/086
See application file for complete search history.

(56) References Cited

U.S. PATENT DOCUMENTS 3,471,182 A * 10/1969 Schroer ..... E04F 11/1817 256/21
3,674,293 A * 7/1972 Parsons ..... F16B 7/0446 182/228.6
3,794,278 A * 2/1974 Frey, Jr. ..... H05K 7/12 248/27.3
5,437,433 A 8/1995 Rezek
5,568,909 A * 10/1996 Timko ..... E04H 12/2269 248/519
6,012,868 A * 1/2000 Aoki ..... E04F 11/181 403/290
6,065,407 A * 5/2000 Wang ..... A47B 57/545 108/110
6,889,960 B1 * 5/2005 Jones ..... E04F 11/1834 256/19
6,971,831 B2 * 12/2005 Fattori ..... F16B 21/082 16/2.1

(Continued)

FOREIGN PATENT DOCUMENTS

DE 19525334 A1 7/1996

*Primary Examiner* — Daniel Wiley
(74) *Attorney, Agent, or Firm* — McGarry Bair PC

(57) ABSTRACT

A baluster connector for interconnecting a baluster with a hollow end to a portion of a railing system by a fastener having a shaft and a head. The body portion can have an opening of sufficient size to pass the head of the fastener toward the second end of the body to seat against a necked-down portion within the interior of the body. Biasing flanges can extend away from the body to provide resistance when the body is positioned within a hollow end of a baluster.

13 Claims, 6 Drawing Sheets

(56) References Cited

U.S. PATENT DOCUMENTS

| | | | | |
|---|---|---|---|---|
| 7,044,448 | B1 * | 5/2006 | Jones | E04F 11/181 256/19 |
| 7,195,222 | B2 * | 3/2007 | Dent | E01F 9/635 248/511 |
| 8,033,530 | B2 * | 10/2011 | Timothy | E04F 11/181 256/22 |
| 8,657,523 | B2 * | 2/2014 | Kuo | E03C 1/0401 211/105.1 |
| 2005/0285091 | A1 * | 12/2005 | Ko | E04H 17/1443 256/24 |
| 2007/0170410 | A1 * | 7/2007 | Devine | E04H 17/1443 256/22 |
| 2009/0200532 | A1 | 8/2009 | Platt | |

* cited by examiner

BALUSTER CONNECTOR

CROSS-REFERENCE TO RELATED APPLICATIONS

This application claims the benefit of U.S. Provisional Patent Application No. 62/088,092, filed Dec. 5, 2014, which is incorporated herein by reference in its entirety.

BACKGROUND OF THE INVENTION

Railings are ubiquitous in commercial and residential building projects which include at least one railing and several balusters extending therebetween. A railing can be disposed horizontally or angularly, depending on whether the railing is located adjacent to a floor surface, a ramp or a stairway. Conventional balusters are attached to a railing by a bracket or a connector by threaded fasteners, or by extruding a connectable section into the center of the hollow baluster, such as a screw boss supported within a hollow baluster by connecting struts.

The typical baluster connector does not always satisfy the consumer's desire for a connection that is difficult to disconnect. The extruded boss-type connection results in a secure connection but can also cause wasted material in the center of the baluster since the baluster is typically connected at each end to the railing. In addition, pre-formed balusters with connection mounts do not typically account for manufacturing tolerances of the baluster, potentially resulting in an insecure mount between the baluster and the rail. One previous baluster connector used friction-fit tapered bosses to create a secure connection. However, it also did not account for the manufacturing tolerance of the hollow baluster, causing some difficulties in achieving a consistent fit between a baluster and a baluster connector. For example, if the baluster-connector fit is too tight, it can be difficult to fully seat the baluster on the connector. Further, when the baluster was driven onto the connector, at times it would shave off a thin piece of the plastic bosses, resulting in an unattractive splay of plastic shavings at the ends of the baluster.

SUMMARY OF THE INVENTION

In one aspect, the invention relates to a connector for interconnecting a baluster with a hollow end to a portion of a railing system having at least a top rail or a bottom rail or both, by a fastener having a shaft and a head, comprising: a body having a first end and a second end; the first end of the body portion having an opening of sufficient size to pass the head of the fastener extending toward the second end of the body, and a plurality of flanges at regular spaced radial intervals adjacent to the first end of the body, each of the plurality of flanges having a biased end extending away from the first end of the body and radially outwardly therefrom; the second end of the body having an opening of sufficient size to pass the shaft portion of the fastener extending toward the first end of the body, and an integral washer portion extending radially from the second end of the body; a necked-down portion located inwardly of the first end and the second end of the body wherein the head-sized opening of the first end of the body transitions to the smaller shaft-size opening of the second end of the body forming a seat for the head of the fastener when the fastener is used to connect the body to a portion of a railing system.

Various alternative embodiments of the invention are also contemplated. For example, the integral washer portion can have spaced-apart openings therein corresponding to the circumferential location of the plurality of flanges at the first end of the body. The integral washer portion can form a barrier between a baluster receiving the first end of the body of the connector and the portion of the railing system to which the connector is mounted. The first end of the body can be received into the hollow end of the baluster after a fastener is passed into the first end of the connector and seated against the necked-down portion when the shaft of the fastener is connected to a portion of the railing system. The necked-down portion can have an included annular portion forming the transition between the head-sized opening of the first end of the body to the smaller shaft-size opening of the second end of the body.

The first end of the body can have a rounded edge thereon. The body can have openings whereby moisture within an attached baluster can drain through the openings. The openings in the body can be located in an outer vertical surface thereof, adjacent to the plurality of flanges thereon. The body can have a generally circular, elliptical or rectangular shape.

DESCRIPTION OF EMBODIMENTS OF THE INVENTION

Figure 1:
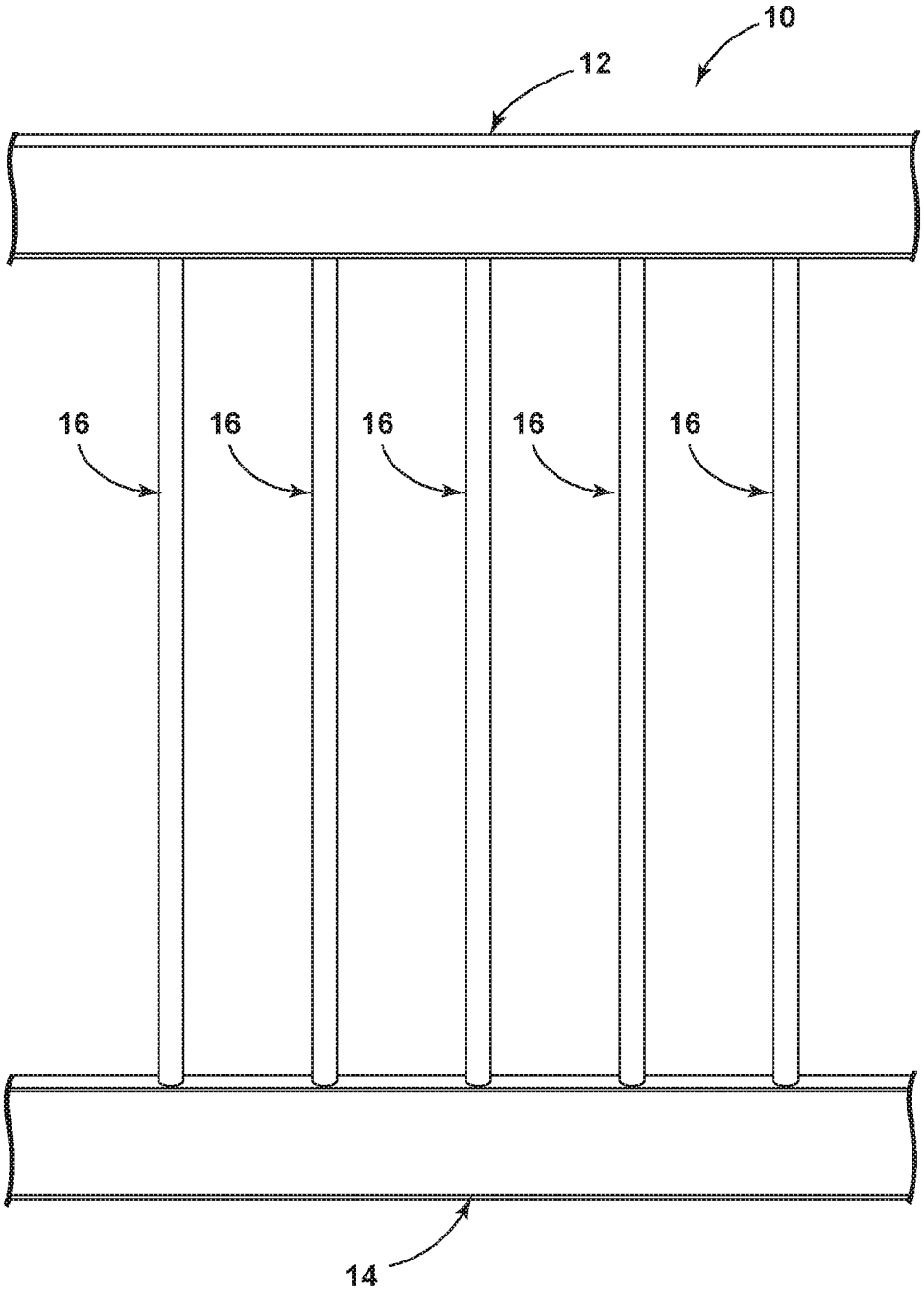
FIG. 1 is a side view of a horizontal railing with a top rail, a bottom rail, and a plurality of balusters therebetween.
Figure 2:
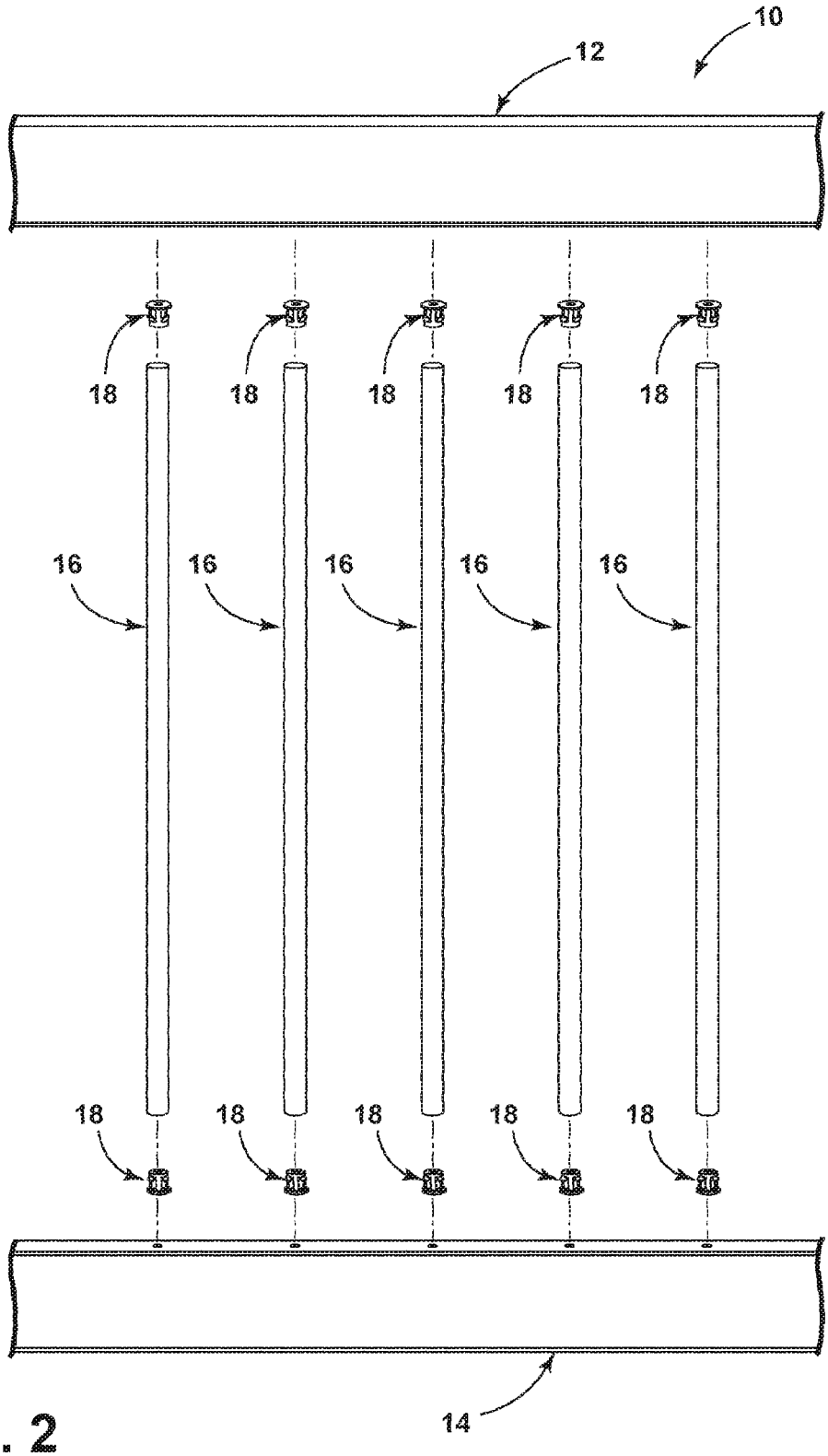
FIG. 2 is an exploded view of the example railing of FIG. 1 showing baluster connectors disposed adjacent to each end of the balusters and between a corresponding top and bottom rail.

Turning now to the drawings, and to FIGS. 1-2 in particular, the invention relates generally to railing systems 10, shown by example in FIGS. 1-2, which typically have a top rail 12, a bottom rail 14, a plurality of balusters 16 spanning a vertical distance between the top rail 12 and bottom rail 14. In some cases, the railing system 10 can only have a top rail 12, and the balusters 16 are connected directly to a floor surface (not shown in the exemplary railing systems shown in FIGS. 1-2). In these figures, a plurality of connectors 18 are shown for interconnecting each baluster 16 to a corresponding top rail 12 or bottom rail 14 of the railing system 10.

Figure 3:
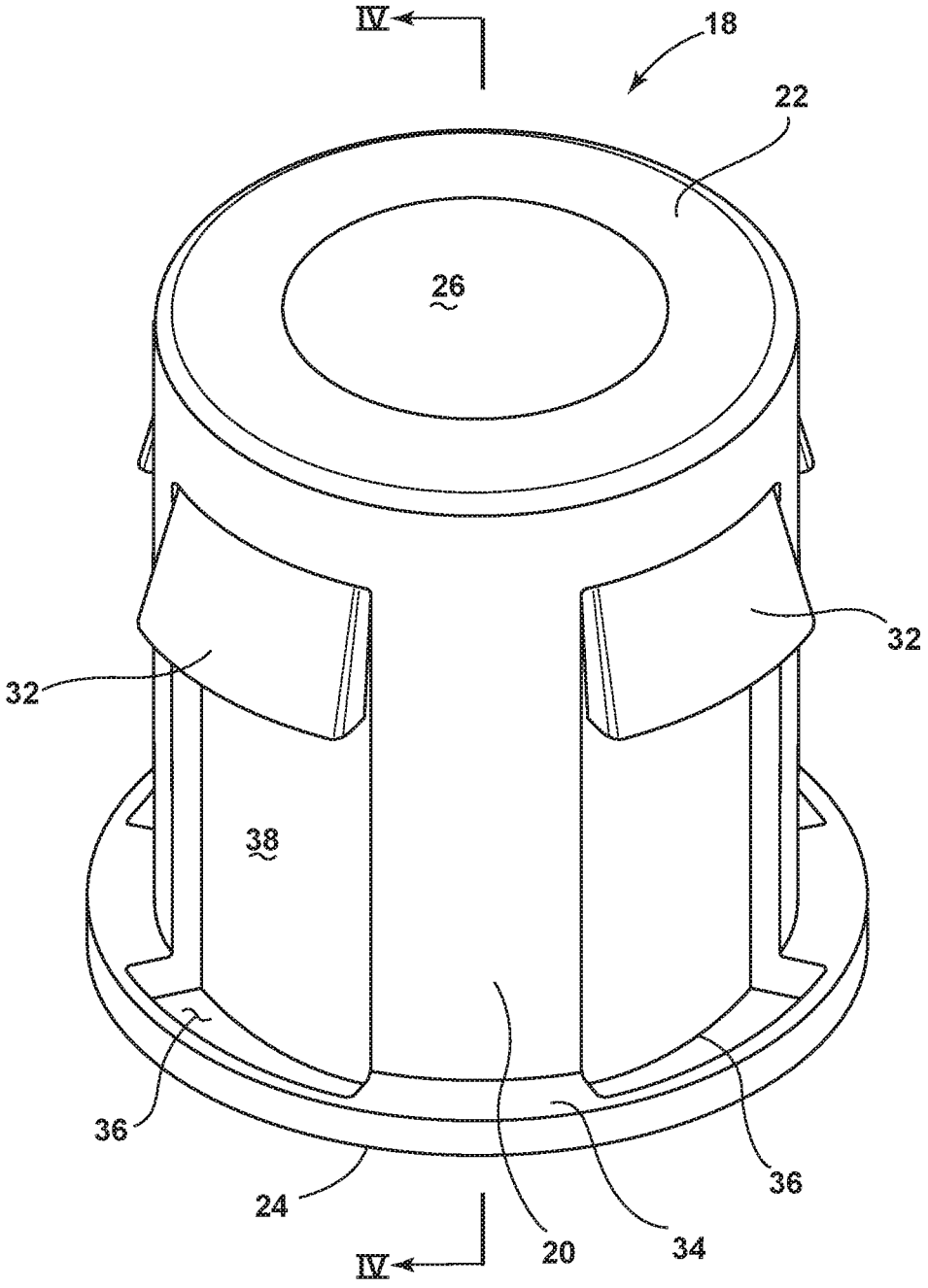
FIG. 3 is a perspective view of the baluster connector shown in FIG. 2.
Figure 4:
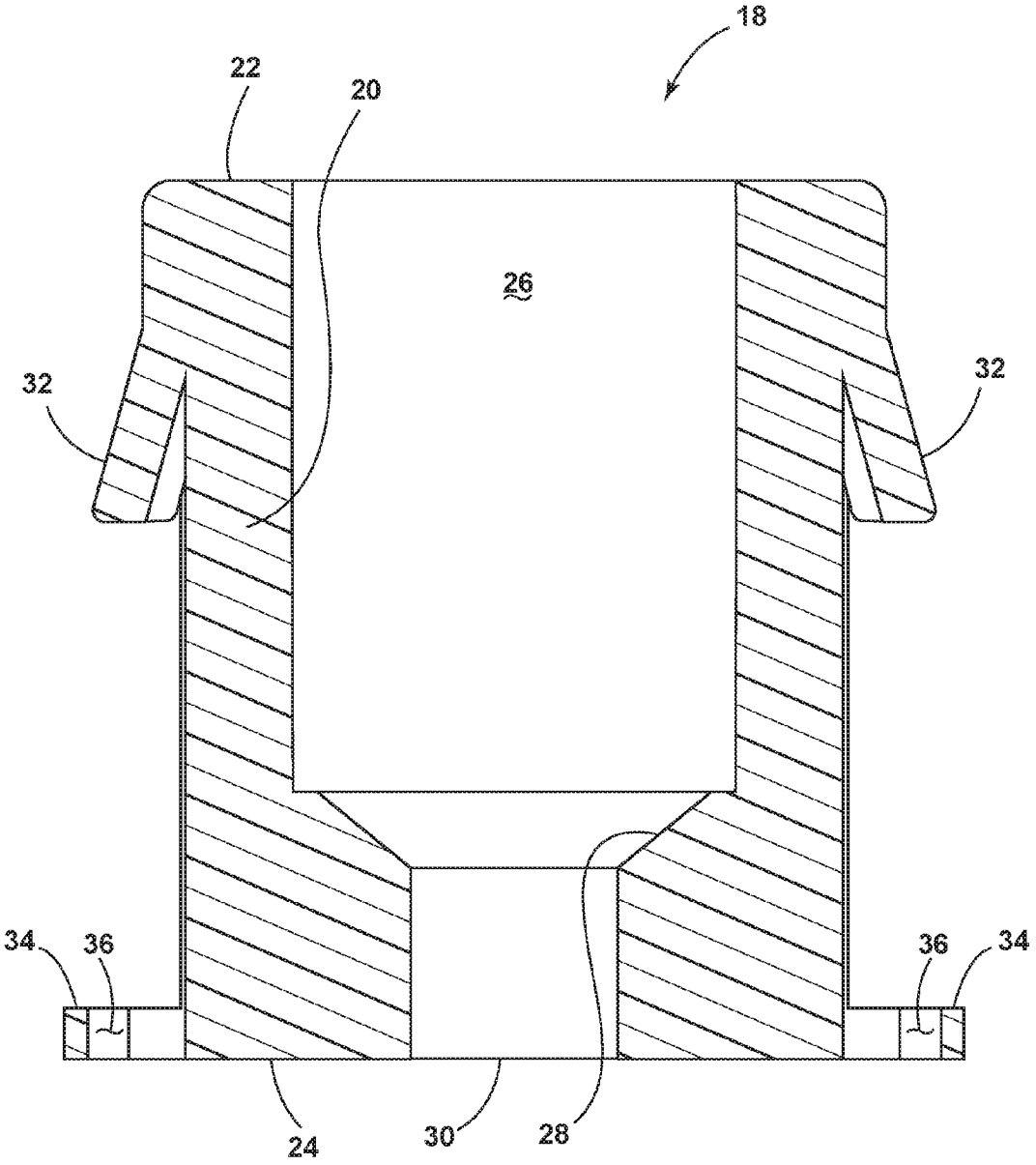
FIG. 4 is a vertical cross-sectional view of the baluster connector of FIGS. 2-3 along line IV-IV of FIG. 3.

The connector 18 is shown by example in greater detail in FIG. 3, and with a vertical-cross-sectional view through lines IV-IV of the connector 18 shown in FIG. 4. The connector 18 generally has a body 20 having a first end 22 and a second end 24. Although the body 20 is shown generally as a cylindrical member having a round cross-section, it will be understood by one skilled in the art that any suitable geometric shape corresponding to a hollow end of a particular baluster 16 being used in the railing system 10 can be employed without departing from the scope of this invention.

The first end 22 of the body 20 of the connector 18 has an opening 26 therein which extends axially through the body 20, and terminates at a necked-down portion 28. An opposite side of the necked-down portion 28 continues to a reduced-diameter portion 30 which exits the body 20 of the connector 18 at the second end 24 thereof. In general, the inner dimension of the opening 26 in the first end 22 of the body 20 of the connector 18 is preferably sized to be slightly larger than a typical fastener, such as a threaded fastener, screw or nail, used to attach the connector 18 to a portion of the railing system 10, such as the top rail 12 or a bottom rail 14. The necked-down portion 28 within the body 20 preferably has an inclined surface thereon, forming a frustoconical shape to allow a head portion of a conventional fastener to seat against the necked-down portion 28. The inner dimension of the opening 30 which exits the second end 24 of the body 20 of the connector 18 is preferably sized to be slightly larger than a shaft portion of a typical conventional fastener, but smaller than the head portion of a conventional fastener to allow the shaft to pass through the openings 26, through the necked-down portion 28 and through the opening 30, while the head portion of a conventional fastener seats against the necked-down portion 28 within the body 20.

The first end 22 of the body 20 of the connector 18 is also provided with one or more laterally-extending flanges 32 which, in the example shown in FIGS. 3-4, are formed integrally adjacent to the first end 22 of the body 20 of the connector 18 and extend in a laterally outwardly and inclined fashion away from the body 20 toward the second end 24 of the body 20 of the connector 18. While the flanges 32 are shown in the example embodiment of FIGS. 3-4, it will be understood that additional or fewer flanges can be provided on the body 20 of the connector 18 without departing from the scope of the invention.

The function of the flanges 32 is to take up any gap between the outer dimension of the body 20 of the connector 18 and a hollow end of a corresponding baluster 16 into which the first end 22 is inserted during assembly of a railing system 10. During insertion of the first end 22 of the body 20 of the connector 18 into a hollow end of a baluster 16, the flanges 32 can be deflected toward the body by the interior of the baluster 16 and the angled nature of the flanges 32 can provide a force to resist removal of the body 20 of the connector 18 from within the baluster 16.

The second end 24 of the body 20 of the connector 18 includes a laterally or radially-extending integrated washer 34. As shown in the example embodiment of FIGS. 3-4, the integrated washer 34 can extend laterally from the second end 24 of the connector 18 and be provided with a plurality of laterally- or radially-spaced openings 36 therethrough. One function of the openings 36 in the integrated washer 34 of the second end 24 of the body 20 of the connector 18 is to provide an opportunity for any liquid that may collect within the interior of a baluster 16 that is inserted over the connector 18 to drain through the openings 36 in the integrated washer 34.

The body 20 of the connector 18 can also be provided with one or more recesses 38 within an outer sidewall of the body 20 of the connector 18. In addition, an opening (not shown in FIGS. 3-4) can be provided within the recesses 38 which communicates with the interior of the openings 26, 28 and 30 within the interior of the body 20 of the connector 18. These openings may be needed in an injection molding process to allow for the connector 18 to be efficiently manufactured. The recesses 38 can also provide a relief on the exterior of the body 20 of the connector 18 to allow for the flanges 32 adjacent the first end 22 thereof to pivot therein, as needed and as a result of the first end 22 of the baluster connector 18 being inserted into a hollow open end of a baluster 16.

Figure 5:
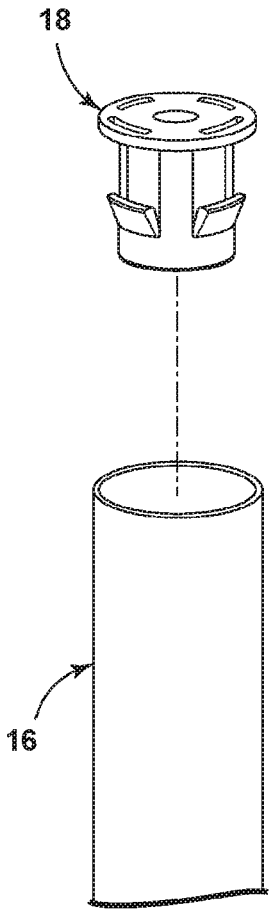
FIG. 5 is a perspective view showing the baluster connector positioned adjacent to a hollow baluster in a similar orientation as that shown in FIG. 2.
Figure 6:
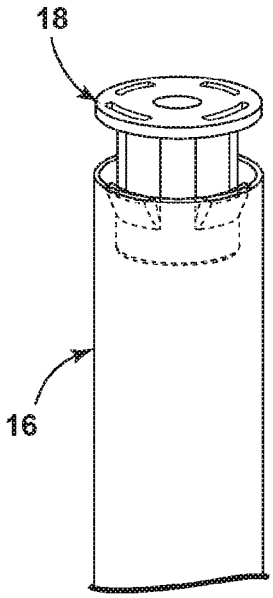
FIG. 6 is a perspective view showing the baluster connector of FIGS. 2-5 being pushed into the hollow baluster.
Figure 7:
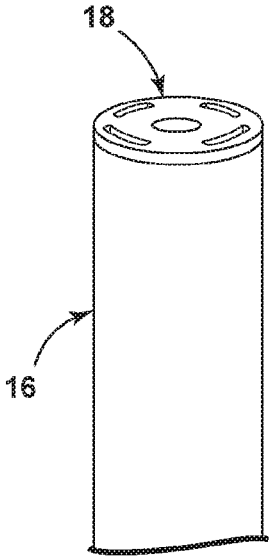
FIG. 7 is a perspective view showing folded baluster connector fully inserted into hollow baluster.

In one example of use of the baluster connector 18, FIG. 5 shows the baluster connector 18 positioned adjacent to a hollow baluster 16 having a hollow end and FIG. 6 shows the baluster connector 18 being pushed into the hollow end of the baluster 16, and, finally, FIG. 7 shows the connector 18 fully inserted within a hollow end of a baluster 17 so that the laterally-extending lip (integrated washer 34) on the end thereof abuts the end of the baluster 16. In this way, the baluster connector 18 can be pre-assembled to one or both ends of a baluster 16 so that the baluster 16 and connector 18 sub-assembly can be mounted to a portion of a railing system 10, such as a top rail 12 or a bottom rail 14 with a known fastener which would engage the connector 18 in a known manner.

Figure 8:
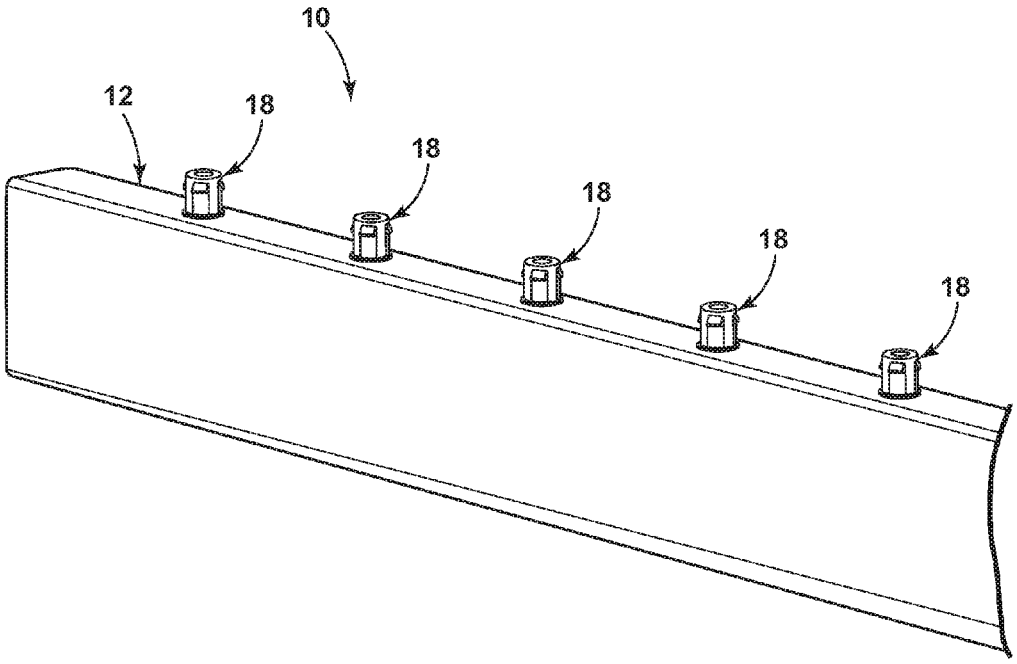
FIG. 8 is a perspective view of the baluster connector of FIGS. 2-6 shown mounted to a top or bottom rail of the railing shown generally in FIG. 1 for assembly of the baluster connector to the rail prior to insertion into a hollow end of a baluster.

In another example of use of the baluster connector 18 in FIG. 8, a plurality of the connectors 18 are shown mounted to a portion of a railing system 10, such as top rail 12 shown in the example of FIG. 8. It will be understood that the connector 18 can be mounted to other portions of a railing system 10 without departing from the scope of this invention, such as the bottom rail 14 or a floor surface or stair tread, for example. In this way, the baluster connector 18 can be pre-assembled to the portion of the railing system 10 in a spaced relationship with other connectors 18. Then, at a desired time, a plurality of balusters can be inserted around each connector 18 by passing an open hollow end of a corresponding baluster 16 over each connector 18. In this matter, a railing system 10 can be pre-assembled anywhere, including at a factory, at a retail establishment, at a job site, or by an end user, without departing from the scope of this invention.

The connector 18 can be formed with any geometric shape to conform with the shape of the baluster 16 used in the railing system 10 including, but not limited to, square, rectangular, round, oval, octagonal and the like. Although a baluster 16 and a connector 18 are shown in the example embodiments described herein as having a generally round cross-section, the particular geometric shape shown in the drawings should not be construed as limiting the scope of the invention. Many other shapes for the exterior of the connector 18 and the interior of the hollow end(s) of the baluster 16 would be readily apparent to one skilled in the art, without needing to be listed specifically here.

The connector 18 has a body 20 with the integral washer 34 forming a laterally-extending lip thereon. The lip on the integrated washer 34 can provide a barrier between the portion of the railing system 10 to which the baluster 16 is being mounted and the baluster 16 into which the connector 18 is inserted to prevent the abutment of differing materials of the railing system 10 and the baluster 16 from abutting one another, in case the baluster 16 and abutting portions of the railing system 10 are of incompatible materials or of materials wherein one of the materials of one component might corrode another material of another component. The optional openings 36 in the integrated washer 34 can allow water and other liquids from the interior of a connected baluster 16 to drain therethrough.

The body of the connector 18 can have openings to allow the part to be easily injection molded, although the particulars of the manufacturing process for the connector 18 should not be construed as limiting the invention in any way.

The top portion of the connector 18 can be formed to preferably be slightly smaller than an inside dimension of an open, hollow end of a corresponding baluster 16. The laterally-extending flanges 32 on the body of the connector can be located on the sides adjacent the first end 22 of the connector 18, extending down at an outward angle to a final, unbiased diameter that is preferably greater than the inside dimension of the baluster so that the flanges provide a biasing force against the interior of the baluster 16 to resist removal of the baluster 16 from the connector 18.

Preferably, the opening 26 at the first end 22 of the connector 18 has a tapered opening through its center, to allow attachment with a conventional fastener.

In another embodiment of the connector 18, the integrated washer 34 may not be continuous with through holes 36 but rather have intermediate gaps along the perimeter at the radial position of the flanges 32, which can allow moisture to drain from the inside of the baluster 16.

The connector 18 can be made from any suitable material including, but not limited to, plastic, composite, metal, wood, fiberglass, or some combination of these materials. In the preferred embodiment, the connector 18 can be made from injection molded plastic.

The invention can be used primarily in the construction of railings adjacent a walking surface such as decks, porches, ramps, and patios. It may also be used while constructing fencing.

This written description uses examples to disclose the invention, including the best mode, and to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A connector for interconnecting a baluster with a hollow end to a portion of a railing system having at least a top rail or a bottom rail or both, by a fastener having a shaft and a head, comprising:

a body having a sidewall extending between a first end and a second end, the body comprising:

the first end of the body having an opening of sufficient size to pass the head of the fastener extending toward the second end of the body;

a set recesses located within the sidewall;

a plurality of flanges laterally extending from the sidewall and where the plurality of flanges are at regular spaced radial intervals about the sidewall of the body and are located on a length of the sidewall such that the plurality of flanges are adjacent to the first end of the body, each of the plurality of flanges having a fixed end connected to and extending from the sidewall and a biased end extending in an included fashion away from the first end of the body and radially outwardly from the sidewall where at least one of the plurality of flanges and a corresponding recess of the set of recesses are positioned such that the corresponding recess provides a relief and the biased end of the at least one of the plurality of flanges are pivotable therein;

the second end of the body having an opening of sufficient size to pass the shaft portion of the fastener extending toward the first end of the body, and an integral washer portion extending radially from the second end of the body; and a necked-down portion located inwardly of the first end and the second end of the body wherein the head-sized opening of the first end of the body transitions to the smaller shaft-size opening of the second end of the body forming a seat for the head of the fastener when the fastener is used to connect the body to a portion of a railing system wherein when the first end of the connector body is engaged within the hollow end of the baluster in an installed state, the plurality of flanges are biased inwardly by, and frictionally engaged with, an inner surface of the baluster.

2. The connector of claim 1 wherein the integral washer portion has spaced-apart openings therein corresponding to the circumferential location of the plurality of flanges at the first end of the body.

3. The connector of claim 2 wherein the integral washer portion forms a barrier between a baluster receiving the first end of the body of the connector and the portion of the railing system to which the connector is mounted.

4. The connector of claim 3 wherein the first end of the body can be received into the hollow end of the baluster after a fastener is passed into the first end of the connector and seated against the necked-down portion when the shaft of the fastener is connected to a portion of the railing system.

5. The connector of claim 1 wherein the necked-down portion has an included annular portion forming the transition between the head-sized opening of the first end of the body to the smaller shaft-size opening of the second end of the body.

6. The connector of claim 1 wherein the first end of the body has a rounded edge thereon.

7. The connector of claim 1 wherein the washer portion has openings whereby moisture within an attached baluster is drainable through the openings.

8. The connector of claim 7 wherein the openings in the washer portion are located in an outer vertical surface thereof, adjacent to the plurality of flanges.

9. The connector of claim 1 wherein the body has a generally circular cross-section.

10. The connector of claim 1 wherein the body has a generally elliptical cross-section.

11. The connector of claim 1 wherein the body has a generally rectangular cross-section.

12. A connector for interconnecting a baluster with a hollow end to a portion of a railing system having at least a top rail or a bottom rail or both, by a fastener having a shaft and a head, comprising:

a body having a sidewall and extending between a first end and a second end, the body comprising:

the first end of the body having an opening of sufficient size to pass the head of the fastener extending toward the second end of the body;

a plurality of flanges laterally extending from the sidewall and where the plurality of flanges are at regular spaced radial intervals about the sidewall of the body and are located on a length of the sidewall such that the plurality of flanges are adjacent to the first end of the body, each of the plurality of flanges having a fixed end connected to the sidewall and a biased end extending in an included fashion away from the first end of the body and radially outwardly from the sidewall;

the second end of the body having an opening of sufficient size to pass the shaft of the fastener extending toward the first end of the body;

an integral washer portion extending radially from the second end of the body; and a necked-down portion located inwardly of the first end and the second end of the body wherein the head-sized opening of the first end of the body transitions to the smaller shaft-size opening of the second end of the body forming a seat for the head of the fastener when the fastener is used to connect the body to a portion of a railing system wherein when the first end of the connector body engaged within the hollow end of the baluster in an installed state, the plurality of flanges are biased inwardly by, and frictionally engaged with, an inner surface of the baluster.

13. A connector for interconnecting a baluster with a hollow end to a portion of a railing system having at least a top rail or a bottom rail or both, by a fastener having a shaft and a head, comprising:

a body having an outer sidewall having a length extending from a first end to a second end, the body comprising:

the first end of the body having an opening of sufficient size to pass the head of the fastener extending toward the second end of the body;

a set of recesses located within the outer sidewall;

a plurality of flanges located at regular spaced radial intervals about the outer sidewall, each of the plurality of flanges having a biased end extending in an included fashion away from the first end of the body and radially outwardly from the outer sidewall and where at least one of the plurality of flanges and a corresponding recess of the set of recesses are positioned such that the corresponding recess provides a relief and the biased end of the at least one of the plurality of flanges is pivotable therein;

the second end of the body having an opening of sufficient size to pass the shaft of the fastener extending toward the first end of the body;

an integral washer portion extending radially from the second end of the body; and a necked-down portion located inwardly of the first end and the second end of the body wherein the head-sized opening of the first end of the body transitions to the smaller shaft-size opening of the second end of the body forming a seat for the head of the fastener when the fastener is used to connect the body to a portion of a railing system wherein when the first end of the connector body engaged within the hollow end of the baluster in an installed state, the plurality of flanges are biased inwardly by, and frictionally engaged with, an inner surface of the baluster.

* * * * *